US006021850A

United States Patent [19]

Wood et al.

[11] Patent Number: 6,021,850

[45] Date of Patent: Feb. 8, 2000

[54] DOWNHOLE PIPE EXPANSION APPARATUS AND METHOD

[75] Inventors: Edward T. Wood, Kingwood, Tex.; Andrew W. Dobson, Aberdeen, United Kingdom

[73] Assignee: Baker Hughes Incorporated, Houston, Tex.

[21] Appl. No.: 08/943,632

[22] Filed: Oct. 3, 1997

[51] Int. Cl.[7] ..... E21B 43/10

[52] U.S. Cl. ..... 166/380; 166/207

[58] Field of Search ..... 166/277, 380, 166/207, 187

[56] References Cited

U.S. PATENT DOCUMENTS

| | | |
|---|---|---|
| 1,634,891 | 7/1927 | Trout . |
| 2,017,451 | 10/1935 | Wickersham . |
| 2,583,316 | 1/1952 | Bannister . |
| 2,593,725 | 4/1952 | Brown . |
| 3,163,217 | 12/1964 | Haeber . |

(List continued on next page.)

FOREIGN PATENT DOCUMENTS

| | | | |
|---|---|---|---|
| 0 418 056 A1 | 9/1989 | European Pat. Off. . | |
| 0976019 | 11/1982 | U.S.S.R. | 166/207 |
| WO 97/17526 | 5/1997 | WIPO . | |

OTHER PUBLICATIONS

"A System: Reeled Completions, Casings and Flowlines," *Reeled Systems Technology*, date unknown, 16–21.

Petroline EST Well Systems brochure, date unknown, 8 pages

Abdrakhmanov, et al., "Isolation Profile Liner Helps Stabilize Problem Well Bores," *Oil & Gas Journal*, Sept. 1995, 50–52.

Gill, et al., "Expandable Tube is Novel Tool for Difficult Completions, Drilling," Oil & Gas Journal, June 1996, 37–40.

Vincent, et al., "Stressed Steel Liner Yields Stronger Casing Repairs," *Journal of Petroleum Technology*, Dec. 1962, 1337–1341.

Kemp, "Field Results of the Stressed Steel Liner Casing Patch," *Journal of Petroleum Technology*, Feb. 1964, 147–149.

Weatherford Enterra advertisement and information regarding Homoco Casing Patches. No date.

"Rubber Seal Casing Patch and Rubber Seal Underwater Casing Patch"; Prod. Nos. 161–20 and 160–78: Baker Oil Tools' Fishing Services, pp. 13–16.

"High Pressure Pack–off"; Prod. No. 110–59, Baker Oil Tools' Fishing Services, p. 54.

Bowen Packer Type Tubing and Casing Patches; p. 930 (No date).

2314 Gotco International, Inc. "Casing Patch," p. 12 (No date).

*Primary Examiner*—William Neuder
*Attorney, Agent, or Firm*—Duane, Morris & Heckscher LLP; Steve Rosenblatt, Esquire

[57] ABSTRACT

A method and apparatus of expanding tubulars is the disclosed. In the preferred embodiment, a rounded tubular is inserted through a larger tubular while suspended on a mandrel. A stop device, such as a liner hanger, is attached to the larger tubular after delivery downhole on the mandrel. Upon engagement of the liner hanger or other stop device to the larger tubular, the mandrel is freely movable with respect to the stop device. The mandrel contains a deforming device such as a conically shaped wedge located below the tubular to be expanded. A force is applied from the surface to the mandrel, pulling the wedge into the tubular to be expanded. When the wedge clears through the tubular to be expanded, it releases the stop device so that the stop device can be retrieved with the mandrel to the surface. Thus, the stop device is supported by the larger tubing while the smaller tubing is expanded when the wedge is pulled through it. Should the tubular being expanded contract longitudinally while it is being expanded radially, it is free to move away from the stop device.

20 Claims, 3 Drawing Sheets

U.S. PATENT DOCUMENTS

| | | | |
|---|---|---|---|
| 3,179,168 | 4/1965 | Vincent . | |
| 3,191,677 | 6/1965 | Kinley . | |
| 3,191,680 | 6/1965 | Vincent . | |
| 3,203,451 | 8/1965 | Vincent . | |
| 3,203,483 | 8/1965 | Vincent . | |
| 3,245,471 | 4/1966 | Howard . | |
| 3,353,599 | 11/1967 | Swift . | |
| 3,358,760 | 12/1967 | Blagg . | |
| 3,412,565 | 11/1968 | Lindsey et al. | 166/207 |
| 3,477,506 | 11/1969 | Malone . | |
| 3,489,220 | 1/1970 | Kinley . | |
| 3,710,864 | 1/1973 | Mitchell . | |
| 3,712,376 | 1/1973 | Owen et al. . | |
| 3,746,091 | 7/1973 | Owen et al. . | |
| 3,785,193 | 1/1974 | Kinley et al. . | |
| 3,865,408 | 2/1975 | Young . | |
| 3,948,321 | 4/1976 | Owen et al. . | |
| 4,483,399 | 11/1984 | Colgate . | |
| 4,501,327 | 2/1985 | Retz . | |
| 4,660,863 | 4/1987 | Bailey et al. . | |
| 4,781,249 | 11/1988 | Wood . | |
| 4,796,709 | 1/1989 | Lynde et al. . | |
| 4,830,109 | 5/1989 | Wedel . | |
| 4,897,139 | 1/1990 | Wood . | |
| 4,907,651 | 3/1990 | Bou-Mikael . | |
| 4,967,846 | 11/1990 | Wood . | |
| 4,976,322 | 12/1990 | Abdrakhmanov et al. . | |
| 5,031,699 | 7/1991 | Artynov et al. . | |
| 5,037,879 | 8/1991 | Roberts . | |
| 5,040,283 | 8/1991 | Pelgrom . | |
| 5,083,608 | 1/1992 | Abdrakhmanov et al. . | |
| 5,119,661 | 6/1992 | Abdrakhmanov et al. . | |
| 5,327,962 | 7/1994 | Head . | |
| 5,333,692 | 8/1994 | Baugh et al. . | |
| 5,337,823 | 8/1994 | Nobileau . | |
| 5,348,095 | 9/1994 | Worrall et al. . | |
| 5,366,012 | 11/1994 | Lohbeck . | |
| 5,390,742 | 2/1995 | Dines et al. . | |
| 5,456,312 | 10/1995 | Lynde et al. . | |
| 5,494,106 | 2/1996 | Gueguen et al. . | |
| 5,667,011 | 9/1997 | Gill et al. . | |
| 5,785,120 | 7/1998 | Smalley et al. | 166/207 |

DOWNHOLE PIPE EXPANSION APPARATUS AND METHOD

FIELD OF THE INVENTION

The field of this invention relates to a method and apparatus of running downhole tubing or casing of a size smaller than tubing or casing already set in the hole and expanding the smaller tubing to a larger size downhole.

BACKGROUND OF THE INVENTION

Typically, as a well is drilled, the casing becomes smaller as the well is drilled deeper. The reduction in size of the casing restrains the size of tubing that can be run into the well for ultimate production. Additionally, if existing casing becomes damaged or needs repair, it is desirable to insert a patch through that casing and be able to expand it downhole to make a casing repair, or in other applications to isolate an unconsolidated portion of a formation that is being drilled through by running a piece of casing in the drilled wellbore and expanding it against a soft formation, such as shale.

Various techniques of accomplishing these objectives have been attempted in the past. In one technique developed by Shell Oil Company and described in U.S. Pat. No. 5,348,095, a hydraulically actuated expanding tool is inserted in the retracted position through the tubular casing to be expanded. Hydraulic pressure is applied to initially expand the tubular member at its lower end against a surrounding wellbore. Subsequently, the hydraulic pressure is removed, the expanding tool is lifted, and the process is repeated until the entire length of the casing segment to be expanded has been fully expanded from bottom to top. One of the problems with this technique is that it is uncertain as to the exact position of the expanding tool every time it is moved from the surface, which is thousands of feet above where it is deployed. As a result, there's no assurance of uniform expansion throughout the length of the casing to be expanded using this technique. Plus, the repeated steps of application and withdrawal of hydraulic pressure, coupled with movements in the Interim, are time-consuming and do not yield with any certainty a casing segment expanded along its entire length to a predetermined minimum inside diameter. U.S. Pat. No. 5,366,012 shows a perforated or slotted liner segment that is initially rigidly attached to the well casing and expanded by a tapered expansion mandrel. This system is awkward in that the slotted liner with the mandrel is installed with the original casing, which requires the casing to be assembled over the mandrel.

Other techniques developed in Russia and described in patents 4,976,322; 5,083,608; and 5,119,661 use a casing segment which is specially formed, generally having some sort of fluted cross-section. The casing segment to be expanded which has the fluted shape is subjected to hydraulic pressure such that the flutes flex and the cross-sectional shape changes into a circular cross-section at the desired expanded radius. To finish the process, a mechanical roller assembly is inserted into the hydraulically expanded fluted section. This mechanical tool is run from top to bottom or bottom to top in the just recently expanded casing segment to ensure that the inside dimension is consistent throughout the length. This process, however, has various limitations. First, it requires the use of a pre-shaped segment which has flutes. The construction of such a tubular shape necessarily implies thin walls and low collapse resistance. Additionally, it is difficult to create such shapes in a unitary structure of any significant length. Thus, if the casing segment to be expanded is to be in the order of hundreds or even thousands of feet long, numerous butt joints must be made in the fluted tubing to produce the significant lengths required. Accordingly, techniques that have used fluted tubing, such as that used by Homco, now owned by Weatherford Enterra Inc., have generally been short segments of around the length of a joint to be patched plus 12–16 ft. The technique used by Homco is to use tubing that is fluted. A hydraulic piston with a rod extends through the entire segment to be expanded and provides an upper travel stop for the segment. Actuation of the piston drives an expander into the lower end of the specially shaped fluted segment The expander may be driven through the segment or mechanically yanked up thereafter. The shortcoming of this technique is the limited lengths of the casing to be expanded. By use of the specially made fluted cross-section, long segments must be created with butt joints. These butt joints are hard to produce when using such special shapes and are very labor-intensive. Additionally, the self-contained Homco running tool, which presents an upper travel stop as an integral part of the running tool at the end of a long piston rod, additionally limits the practical length of the casing segment to be expanded.

What is needed is an apparatus and method which will allow use of standard pipe which can be run in the wellbore through larger casing or tubing and simply expanded in any needed increment of length. It is thus the objective of the present invention to provide an apparatus and technique for reliably inserting the casing segment to be expanded and expanding it to a given inside dimension, while at the same time accounting for the tendency of its overall length to shrink upon expansion. Those and other objectives will become apparent to those of skill in the art form a review of the specification below.

SUMMARY OF THE INVENTION

A method and apparatus of expanding tubulars is the disclosed. In the preferred embodiment, a rounded tubular is inserted through a larger tubular while suspended on a mandrel. A stop device, such as a liner hanger, is attached to the larger tubular after delivery downhole on the mandrel. Upon engagement of the liner hanger or other stop device to the larger tubular, the mandrel is freely movable with respect to the stop device. The mandrel contains a deforming device such as a conically shaped wedge located below the tubular to be expanded. A force is applied from the surface to the mandrel, pulling the wedge into the tubular to be expanded. When the wedge clears through the tubular to be expanded, it releases the stop device so that the stop device can be retrieved with the mandrel to the surface. Thus, the stop device is supported by the larger tubing while the smaller tubing is expanded when the wedge is pulled through it. Should the tubular being expanded contract longitudinally while it is being expanded radially, it is free to move away from the stop device.

DETAILED DESCRIPTION OF THE PREFERRED EMBODIMENT

Figure 1A:
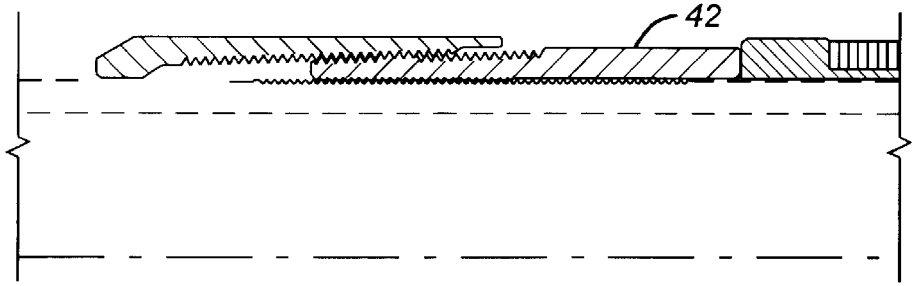
FIGS. 1*a*–1*f* illustrate the apparatus in section, employing the method of the present invention, showing the wedge having moved in part way through the tubular to be expanded.
Figure 1B:
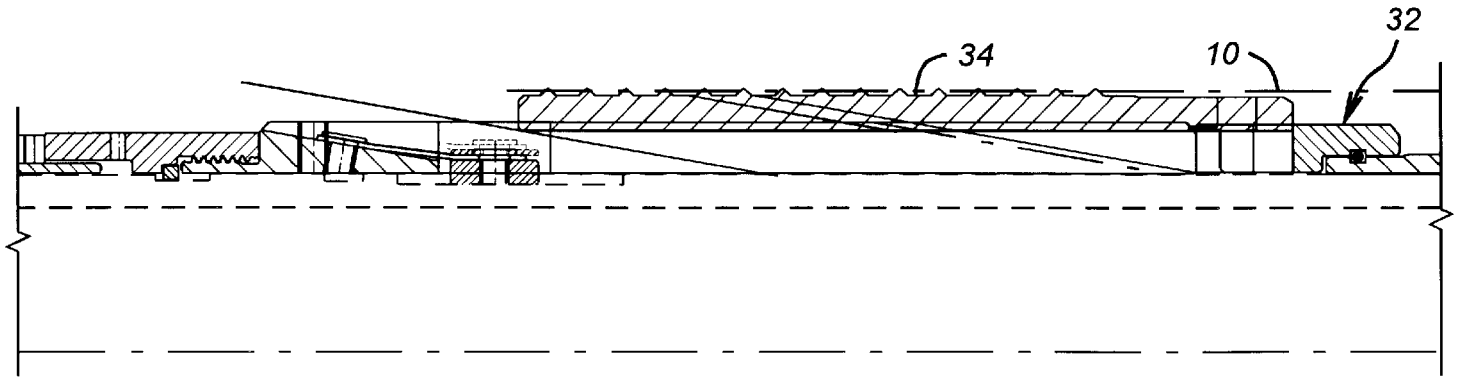
Figure 1C:
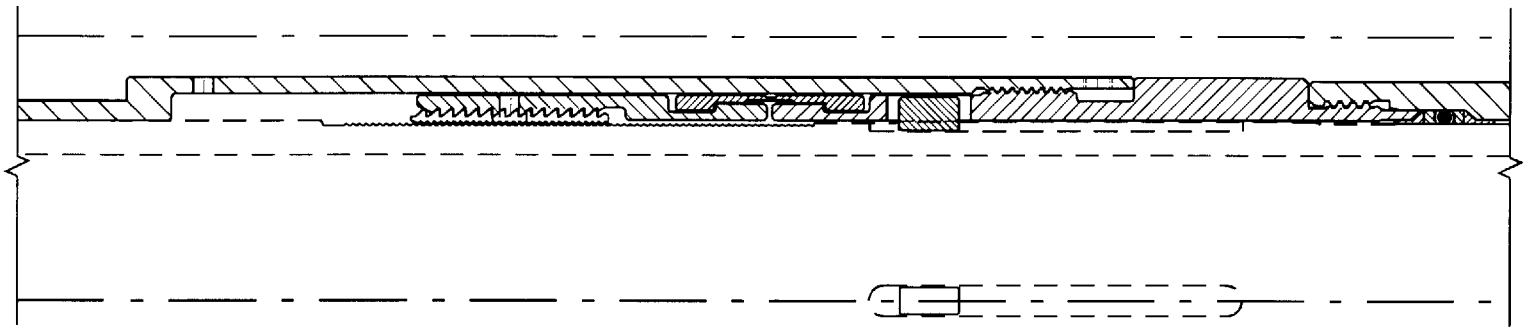
Figure 1D:
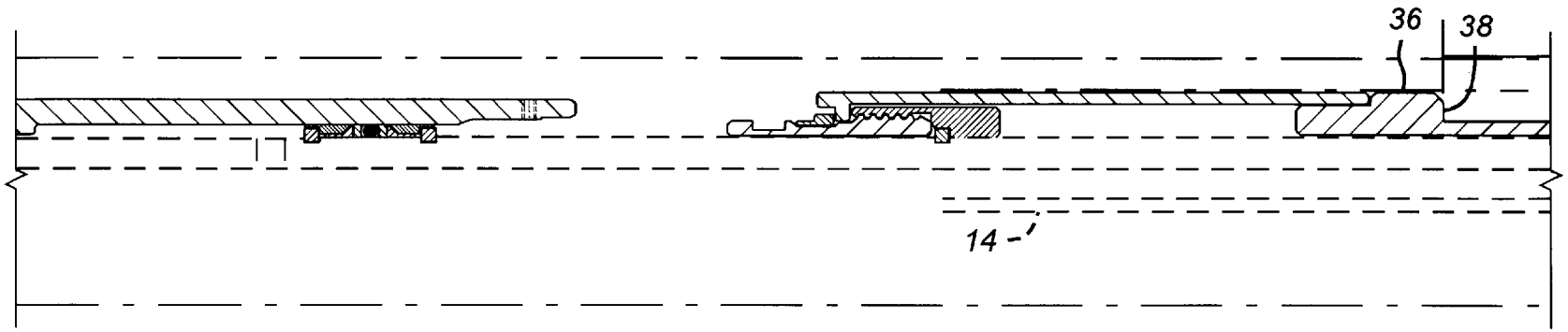
Figure 1E:
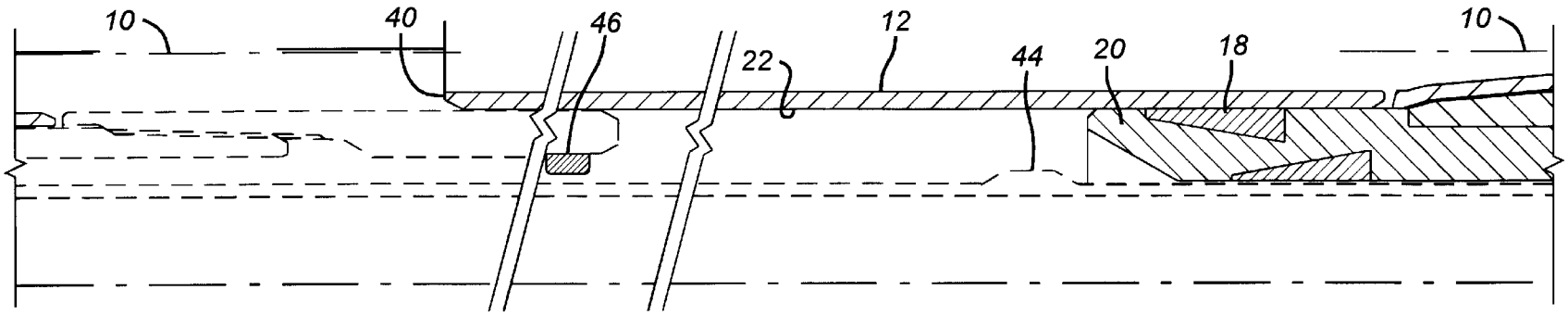
Figure 1F:
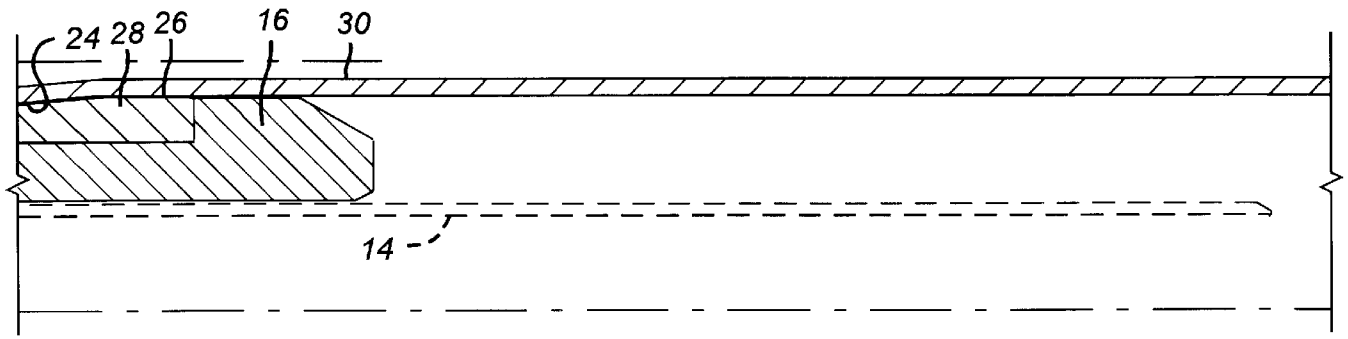

Referring now to FIGS. 1*a*–1*f*, the larger casing 10 is shown schematically in FIGS. 1*b*, 1*e*, and 1*f*. A smaller tubular 12, which is preferably rounded in cross-section, has been inserted through the casing 10. The tubular 12 is supported on a mandrel 14. Connected to mandrel 14 is conical wedge 16. Other shapes are within the scope of the invention. Conical wedge 16 is connected to mandrel 14 through a key or lock 18. Wedge 16 can be a fixed taper or can be an adjustable taper which can be set downhole from the surface to a predetermined diameter and can also be selectively collapsed for an emergency release. At the upper end of the wedge 16 is a guide 20. Guide 20 is small enough to enter the smallest inside diameter of the tubular 12, as represented by numeral 22, ahead of the wedge segment 24. The wedge segment 24 has a final expanded diameter represented by numeral 26, and may contain hard-faced replaceable components 28. The components 28 literally contact the inside surface of the tubular 12 to expand it to the diameter indicated by numeral 26. As shown in FIGS. 1*e* and 1*f*, the expanded diameter 26 results in the outer surface 30 being pushed into firm contact with the casing 10 or, alternatively, the wellbore itself.

To accomplish the expansion of the tubular 12, the mandrel 14 also supports a known liner hanger 32, such as one available from Baker Oil Tools as Product No. 292730007. This tool is mechanically set and released and is adapted to release upon a predetermined mandrel movement. The liner hanger 32 can be actuated mechanically or hydraulically. It contains slip elements 34 which, when actuated, bite into the casing 10. The lower end 36 of the liner hanger 32 has a radial surface 38 that acts as a travel stop for the upper end 40 as the guide 20 is brought up, moving the wedge segment 24 into the tubular 12, pushing end 40 against radial surface 38. When the slip elements 34 are set against the casing 10, the liner hanger 32 is released from the mandrel 14, thus allowing the mandrel 14 to be picked up from the surface via a tubing string, partially shown as 42. Thus, the proper sequence is the running in of the tubular 12 to be expanded, supported on the conical wedge 16, which is in turn keyed to the mandrel 14. The tubing string 42 also supports the liner hanger 32. When the liner hanger 32 is positioned properly within the casing 10, it is actuated from the surface. Once fixated to the casing 10, the liner hanger 32, through its radial surface 38, acts as a travel stop for the tubular 12 at upper end 40. The liner hanger 32 is at this time released from the mandrel 14 so that the mandrel 14, with the tubing string 42, can be pulled upwardly from the surface.

The upward pulling from the surface allows the hard-faced components 28, which contain the wedge shape 24, to begin to flare out the tubular 12 to diameter 26. Continued pulling from the surface advances the mandrel 14 and the conical wedge 16 through the tubular 12. It has been observed through experimentation that the act of increasing the diameter of a rounded tubular 12 from diameter 22 to diameter 26 can result in a decrease in its longitudinal length. Thus, as shown in FIG. 1*e*, the upper end 40 can pull away from radial surface 38 as the radial expansion of tubular 12 progresses by advancement uphole of mandrel 14 with conical wedge 16. Eventually, tab 44 on mandrel 14 contacts ring 46, which is part of the liner hanger 32. An upward force is thus exerted on the liner hanger 32, causing the slip elements 34 to release from the casing 10 in a known manner. The mandrel 14 can then remove the liner hanger 32 by a continued applied force uphole from the surface.

Thus, it is seen that the technique of the present invention involves running in on a mandrel, such as 14, a preferably rounded shape to be expanded to a larger inside and outside diameter. This rounded tubular 12 is supported on a wedge assembly 16 connected to the mandrel 14. The length of the mandrel 14 and, hence, the length of the tubular 12 can be whatever is desired for the particular application. In the preferred embodiment, standard tubulars available in the oilfield are used as liner 12. Thus, any length can be obtained by using known thread or other connections to create a tubular 12 as long as is desired for the particular application. Similarly, the mandrel 14 itself can be made as long as is necessary so that it can extend through whatever length of tubular 12 is employed for the particular application. Thus, lengths well in excess of 60 feet up to thousands of feet can be expanded. It should be noted that there are limits to the amount of radial expansion of a given size tubular 12. Thus, the amount of radial expansion, and to some degree the overall length of the tubular 12 to be radially expanded, has a bearing on the amount of force that is required at the surface for pulling and necessarily the amount of stress to which the mandrel 14 will be subjected.

Apart from the advantage of being able to use standard oilfield tubulars for the tubular 12 is the further advantage of using a known travel stop, such as a liner hanger 32, which is initially supported by the mandrel 14 but is released from the mandrel 14 when fixated to the casing 10. The mandrel 14 then releases the liner hanger 32 when the conical wedge 16 has fully progressed through the tubular 12.

The technique as described above has numerous advantages over prior techniques. It allows the use of standard oilfield tubulars for the tubular 12. It allows the radial expansion of any necessary length of tubular 12 in a smooth pull applied from the surface. This is to be contrasted with prior techniques which have involved the use of hydraulic pressure to expand, in series, adjacent portions of a tubular.

Another advantage is by providing a stop device, such as a liner hanger 32, which is located by the mandrel 14 and then released from the mandrel, the apparatus and method of the present invention facilitate the use of lengthy segments of tubing or liner 12 to be expanded. This feature, in conjunction with the use of standard tubulars with known thread or other connectors, also facilitates the use of lengthy segments to be expanded. This is to be contrasted with prior devices, such as the Homco, now Weatherford Enterra design, which uses pre-shaped tubulars which have a travel stop integral with the mandrel and which necessarily are generally limited to short lengths of approximately the length of a joint plus 12–18 ft. By not having to use preformed shapes to get a diameter reduction to facilitate insertion through a larger casing 10, the apparatus and method of the present invention is more economical and provides greater collapse resistance when expanded than the fluted designs. Additionally, unlike some prior techniques developed in Russia, the technique of the present invention allows the predictable expansion of a tubular such as 12 in a smooth, one-step operation which entails pulling up the wedge-shaped element 16 to create the enlarged inside diameter 26. The amount of diameter change from diameter 22 to diameter 26 is known and is preferably accomplished mechanically, as illustrated in FIGS. 1*e* and 1*f*. Allowances for longitudinal contraction of the tubular 12 are also part of the design. Once a portion of the tubular 12 has been expanded to diameter 26, it essentially anchors itself to the casing 10 or the wellbore and thus its upper end is free to move away from radial surface 38 of the liner hanger 32. The length of the tubular 12 can be as short or as long as is required for the application, with the only limitation being that the pulling of the tapered wedges 16, which expand the tubular 12 from diameter 22 to diameter 26 internally, does not cause an overstress in the mandrel 14, which is being forced upwardly from the surface.

The foregoing disclosure and description of the invention are illustrative and explanatory thereof, and various changes in the size, shape and materials, as well as in the details of the illustrated construction, may be made without departing from the spirit of the invention.

We claim:

1. A method of expanding a smaller tubular against a larger tubular or a borehole, comprising:

supporting the smaller tubular on a mandrel;

running in a travel stop with the mandrel;

fixing the travel stop directly to the larger tubular or borehole at any predetermined location independently of any borehole support;

moving the mandrel with respect to the travel stop;

expanding the diameter of the smaller tubular as a result of moving the mandrel.

2. The method of claim 1, further comprising:

releasing the travel stop with the mandrel after expanding the diameter of at least a portion of the smaller tubular.

3. The method of claim 1, further comprising:

using a tubular with a rounded cross-section for the smaller tubular.

4. The method of claim 3, further comprising:

using an expansion member on said mandrel to expand the diameter of the small tubular.

5. The method of claim 1, further comprising:

using a liner hanger as the travel stop.

6. The method of claim 3, further comprising:

using a series of rounded tubulars connected together as the smaller tubular.

7. The method of claim 6, further comprising:

connecting the rounded tubulars with threaded joints.

8. The method of claim 7, further comprising:

using a smaller tubular that exceeds 60 feet in length.

9. The method of claim 5, further comprising:

releasing the liner hanger with the mandrel after the expansion member passes through the expanded smaller tubular.

10. A method of expanding a smaller tubular against a larger tubular or a borehole, comprising:

supporting the smaller tubular on a mandrel;

running in a travel stop with the mandrel;

fixing the travel stop to the larger tubular or borehole;

moving the mandrel with respect to the travel stop;

expanding the diameter of the smaller tubular as a result of moving the mandrel;

using a tubular with a rounded cross-section for the smaller tubular;

using an expansion member on said mandrel to expand the diameter of the small tubular;

providing a guide to enter the smaller tubular as a guide for the expansion member.

11. The method of claim 10, further comprising:

supporting the smaller tubular with a conically shaped expansion member prior to radially expanding it.

12. A method of expanding a smaller tubular against a larger tubular or wellbore, comprising:

running in a round smaller tubular, having a diameter, supported by an expanding member into a larger tubular or a wellbore;

engaging a releasable travel stop for the smaller tubular directly to the larger tubular or wellbore at any predetermined location independently of any tubular support;

increasing the diameter of the rounded smaller tubular to a desired final diameter by forcing the expanding member through said rounded smaller tubular.

13. The method of claim 12, further comprising:

using a mandrel to support the smaller tubular and to position the travel stop in the larger tubular or wellbore.

14. The method of claim 13, further comprising:

releasing the travel stop from the mandrel after releasably fixating the travel stop in the larger tubular or wellbore.

15. The method of claim 14, further comprising:

releasing the travel stop with the mandrel after increasing the diameter of the smaller rounded tubular.

16. The method of claim 15, further comprising:

retrieving the expanding member and travel stop with the mandrel.

17. The method of claim 12, further comprising:

using a plurality of joints of rounded tubulars which are threaded together as the smaller tubular.

18. The method of claim 17, further comprising:

using an assembly of joints of rounded tubulars that exceeds 60 ft in length.

19. The method of claim 12, further comprising:

using a wedge having a conical profile as the expanding member.

20. The method of claim 19, further comprising:

providing replaceable components which comprise the conical profile to facilitate their replacement in the event of wear.

* * * * *